United States Patent [19]

Winters et al.

[11] Patent Number: 4,807,717

[45] Date of Patent: Feb. 28, 1989

[54] METHOD OF LOGGGING AN INCLINED WELLBORE

[75] Inventors: Warren J. Winters, Tulsa; Johnie L. Landreth, Bixby, both of Okla.

[73] Assignee: Amoco Corporation, Chicago, Ill.

[21] Appl. No.: 115,088

[22] Filed: Oct. 30, 1987

[51] Int. Cl.[4] ..... G01V 1/40

[52] U.S. Cl. ..... 181/102; 367/911; 166/99; 75/50

[58] Field of Search ..... 166/64, 65.1, 66, 99, 166/250; 175/50, 244, 249; 181/102, 104, 105, 106; 367/25, 33, 911, 912, 86

[56] References Cited

U.S. PATENT DOCUMENTS 3,052,838 9/1962 Bennett et al. ..... 175/50

3,149,683 9/1964 Clements et al. ..... 175/50

4,457,370 7/1984 Wittrisch ..... 166/250

*Primary Examiner*—Brian S. Steinberger

*Attorney, Agent, or Firm*—Scott H. Brown; F. E. Hook

[57] ABSTRACT

A method is disclosed for logging a formation penetrated by an inclined or horizontal wellbore utilizing a conventioanl logging tool. A collar catcher assembly is attached to a lower portion of a drillstring and a collar is attached to an upper portion of a logging tool. The drillstring is lowered within the wellbore to a position adjacent the formation to be logged. The logging tool is transported through the drillstring until the collar thereon engages and is restrained by the catcher assembly. Then the formation is logged while the drillstring is withdrawn through the wellbore.

3 Claims, 1 Drawing Sheet

METHOD OF LOGGGING AN INCLINED WELLBORE

BACKGROUND OF THE INVENTION

1. Field of the Invention

The present invention relates to a method of logging a subterranean formation penetrated by an inclined wellbore and, more particularly, to such a method whereby a logging tool is restrained within a drillstring and the formation is logged while the drillstring is withdrawn.

2. Setting of the Invention

It is well known in the art to conduct logging operations within a wellbore that penetrates at least one subterranean formation. It is further well known to conduct such operations within steeply inclined and horizontal wellbores. However, horizontal wellbores cannot be logged in conventional fashion since a logging tool assembly will not drop under its own weight on a wireline cable to the end of the 90° curved portion. To conduct such operations, a logging tool is connected to an end of a flexible tubing string that is lowered/raised within the wellbore. Commercially available pipe-conveyed logging systems include Institut Francais Du Petrole "SIMPHOR," Gearhart Industries "TOOL PUSHER," Atlas "SLANT-HOLE EXPRESS" and Welex's "PLS." All of these systems are relatively complex and expensive to operate.

There is a need for a simple method of logging an inclined wellbore which does not require the use of a separate tubing string or can utilize conventional, less costly logging tools.

SUMMARY OF THE INVENTION

The present invention has been contemplated to overcome the foregoing deficiencies and meet the above described needs. Specifically, the present method comprises attaching a collar catching assembly to a lower portion of a conventional drillstring and a clamp on logging tool collar is attached to an upper portion of a conventional logging tool. The drillstring is lowered within the inclined wellbore to a position adjacent the formation to be logged. The logging tool is then lowered and pumped through the drillstring until the collar engages and is restrained by the collar catcher assembly. The formation is logged while the drillstring (and the logging tool) is withdrawn through the wellbore.

BRIEF DESCRIPTION OF THE DRAWING

The Drawing is a cut-away elevational view of a logging tool about to engage a catcher assembly attached to a lower end of a drillstring in accordance with the present invention.

DETAILED DESCRIPTION OF THE PREFERRED EMBODIMENT

Figure 1:
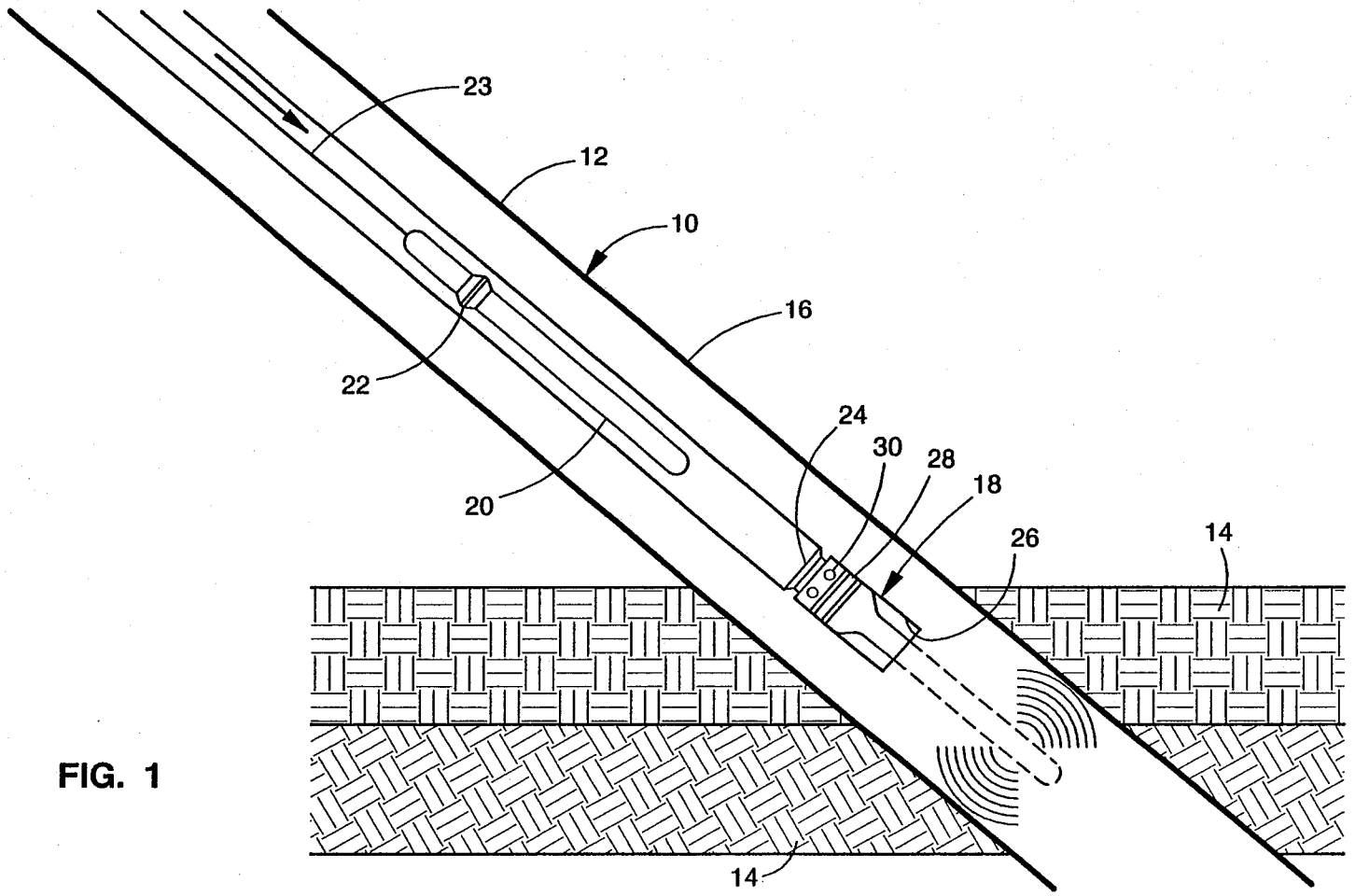

The present invention comprises a method for logging steeply inclined and horizontal wellbores. Prior to a discussion of the method of the present invention, a discussion will be provided of the apparatus utilized. As shown in the Drawing, a wellbore 10 has been drilled in the earth and includes casing string 12, as is well known in the art. The wellbore 10 penetrates, at an inclined angle, one or more subterranean formations 14. Coaxially disposed within the wellbore 10 and casing string 12 is a drillstring 16 which has a collar catcher assembly 18 connected to a lower end thereof by way of threaded connections, pin and slot connectors or the like. The present invention can be used in cased as well as uncased wellbores. Also, disposed within the drillstring 16 is a logging tool 20 which has attached to an upper portion thereof a clamp-on logging tool collar or pump down collar 22. A multichannel transmission and transport cable 23 is operatively attached to the logging tool 20, as is well known in the art. The collar 22 comprises a single piece or multipiece annular ring that is snapped together around or slipped over an end of the logging tool 20. The collar 22 can be rigidly connected to the tool 20 by bolts or pins, or by welding. The collar 22 is preferably connected to an upper portion of the logging tool 20 so that a major portion of the logging tool 20 extends through and out the lower end of the drillstring 16 and catcher assembly 18, as will be described below.

The catcher assembly 18 can include tubing connection devices 24 on an upper end thereof, as previously described, for connection to a lower end of the drillstring 16. The catcher assembly 18 includes an axial bore 26 therethrough which has an inside diameter greater than the outside diameter of the logging tool 20 and the collar 22. Mounted within the catcher assembly 18 around the bore 26 is at least one annular snap ring 28, that is adapted to be depressed by the collar 22 passing thereacross and then move outwardly to restrain the movement of the collar 22 and thus the logging tool 20.

To permit fluid circulation once the collar 22 is engaged by the snap ring 28, at least one fluid bypass port 30 is provided and extends from the bore 26 through the catcher assembly 18.

In accordance with one embodiment of the present invention, the following method is utilized:

1. The latch sub or collar catcher assembly 18 is attached to the bottom of the drillstring 16 via a threaded connection 24.
2. The drillstring 16 is lowered to the desired starting location in the wellbore 10 adjacent, above or below the formation(s) 14 to be logged.
3. A wireline conductor cable 23 is threaded through a packoff assembly (not shown) located on top of the drilling rig rotary swivel (not shown).
4. The logging tool 20 is attached to the wireline cable 23.
5. The pumpdown collar 22 is clamped around the logging tool 20.
6. The logging tool 20 is inserted in the drillstring 16.
7. The rotary swivel is attached to the upper end of the drillstring 16.
8. The logging tool 20 is lowered under its own weight inside the drillstring 16 while fluid is circulated through the drillstring 16 to hydraulically assist and transport the logging tool 20.
9. At high angles and in horizontal wellbores 10, the logging tool 20 is conveyed to the latch sub or collar catcher assembly 18 by hydraulic pumpdown action. The clamp-on logging tool collar 22 produces an adequate piston effect for movement by pumpdown yet sufficient clearance is provided between the collar 22 and the wellbore 10 or casing 12 so that fluid flows relatively unrestricted past the collar 22 and throughout the entire drillstring 16 as the logging tool 20 is being pumped down.
10. Upon arrival at the collar catcher assembly 18, the logging tool 20 passes through the end of the collar catcher assembly 18 such that it protrudes a predetermined distance beyond the end of the casing 12 or drillstring 16. The pumpdown collar 22 seats in the collar stop portion, i.e., the snap ring 28, of the collar catcher assembly 18, thus preventing the logging tool 20 from exiting the drillstring 16.

11. The collar stop/snap-ring 28 produces an interference grip on the collar 22. The collar 22 is thus resisted from becoming inadvertently unseated. Also, the wireline operator receives a clear indication at the surface that the collar 22 is correctly seated in the assembly 18 because, with the snap-ring 28 engaged, several hundred pounds of additional cable tension is required to lift the logging tool 20 inside the drillstring 16.

12. The drilling rig tool operator receives a clear indication at the surface that the logging tool 20 is latched-in because, with the pumpdown collar 22 seated, fluid flow is restricted through the bottom of the assembly 18 and routed primarily through circulation ports 30 which are positioned in the assembly 18 above the snap-ring 28. This produces a detectable change at the surface in the fluid circulation pressure. The size of the circulation ports 30 can be adjusted relative to the clearance of the pumpdown collar 22 and the bore of the drillstring 16 to produce either a pressure increase or pressure decrease when the collar 22 seats in the assembly 18.

13. The logging operation is conducted by hoisting the drillstring 16 at a controlled rate as the wireline operator spools the conductor cable 23 to maintain cable tension. A length of hole equivalent to the hoisting distance of the drilling rig is logged, whereupon it becomes necessary to remove the section of drillstring 16 that has been hoisted above the rig floor.

14. The wireline operator applies several hundred pounds of additional tension to the conductor cable 23 in order to release the logging tool 20 from the assembly 18. The logging tool 20 is then retrieved through the entire drillstring 16 and pulled into the uppermost section of drillstring 16.

15. The stand of pipe is disconnected from the drillstring 16 and from the rig hoisting equipment.

16. The logging tool 20 is retrieved through the top of the removed pipe section. It is then guided back into the drillstring 16, whereupon Steps 7–16 are repeated until the desired section(s) of wellbore 10 has been logged.

Wherein the present invention has been described in particular relation to the Drawing attached hereto, it should be understood that other and further modifications, apart from those shown or suggested herein, may be made within the scope and spirit of the present invention.

What is claimed is:

1. A method of logging a formation penetrated by an inclined or horizontal wellbore, comprising:

(a) attaching a collar catcher assembly to a lower portion of a drillstring;

(b) attaching a collar on an upper portion of a logging tool;

(c) lowering the drillstring within the inclined wellbore to a position adjacent the formation to be logged.

(d) introducing the logging tool through the drillstring until the collar engages and is restrained by the catcher assembly and a lower portion of the logging tool extends out from a lower end of the drillstring; and (e) logging the formation while withdrawing the drillstring and with the logging tool extending out from a lower end of the drillstring; and wherein the collar catcher assembly includes a fluid bypass port in communication with the axial bore to provide a mechanism to generate a fluid pressure indication to the surface to indicate the logging tool collar is substantially restrained within the collar catcher assembly.

2. The method of claim 1 wherein the logging tool is transported through the drillstring by fluid pumped through the drillstring.

3. A logging assembly for logging a formation penetrated by an inclined or horizontal wellbore, comprising:

a collar catcher assembly connectable to a lower end of a drillstring, the collar catcher assembly comprises a tubular body having an axial bore therethrough, and at least two annular rings disposed around the axial bore; and collar means removably connectable to an upper portion of a logging tool, the collar means adapted to be releasably restrained by the annular ring within the collar catcher when the logging tool is displaced through the axial bore so that a lower portion of the logging tool extends out from a lower end of the drillstring while the drillstring and logging tool are removed from the wellbore; and wherein the collar catcher assembly includes a fluid bypass port in communication with the axial bore to provide a mechanism to generate a fluid pressure indication to the surface to indicate the logging tool collar is substantially restrained within the collar catcher assembly.

* * * * *